US010285894B1

(12) United States Patent
Haenel

(10) Patent No.: US 10,285,894 B1
(45) Date of Patent: May 14, 2019

(54) HOVERBOARD WALKER ATTACHMENT APPARATUS

(71) Applicant: Robert Haenel, Compton, CA (US)

(72) Inventor: Robert Haenel, Compton, CA (US)

( * ) Notice: Subject to any disclaimer, the term of this patent is extended or adjusted under 35 U.S.C. 154(b) by 0 days.

(21) Appl. No.: 15/690,132

(22) Filed: Aug. 29, 2017

(51) Int. Cl.
*A61H 3/04* (2006.01)

(52) U.S. Cl.
CPC ..... *A61H 3/04* (2013.01); *A61H 2003/043* (2013.01)

(58) Field of Classification Search
CPC .... A61H 3/04; A61H 2003/043; A61G 5/047; B62K 11/007; B62B 5/005; B62B 2207/00; B62B 2207/02
See application file for complete search history.

(56) References Cited

U.S. PATENT DOCUMENTS 5,016,720 A * 5/1991 Coker ..... A61G 5/047 180/13
5,651,422 A * 7/1997 Casali ..... A61G 5/047 180/13
5,826,670 A * 10/1998 Nan ..... A61G 5/047 180/15
6,360,836 B1 * 3/2002 Milano, Jr. ..... B62B 5/005 180/65.6
6,378,883 B1 4/2002 Epstein
6,896,079 B1 * 5/2005 Axelsson ..... A61G 5/047 180/11
7,000,933 B2 * 2/2006 Arling ..... B62D 51/008 180/218
7,445,217 B1 * 11/2008 Price ..... A61H 3/04 135/67
7,635,037 B2 * 12/2009 Treadwell ..... B62B 5/005 180/19.3
7,694,991 B2 * 4/2010 Mills ..... A61G 5/1051 180/11
7,699,128 B1 * 4/2010 Strauss ..... B62B 5/0026 180/23
7,976,049 B2 * 7/2011 Chiu ..... A61G 5/047 180/13
8,532,841 B2 * 9/2013 Fu ..... A61H 3/04 135/67
8,684,113 B1 * 4/2014 Laconis ..... A61G 5/047 180/11
8,752,658 B2 * 6/2014 Kurek ..... A61H 3/04 180/19.1
9,051,026 B2 * 6/2015 Whitener ..... B62K 3/002
9,272,589 B2 * 3/2016 Yamano ..... B60D 1/00
9,326,901 B2 * 5/2016 Conte ..... A61G 5/047
9,403,573 B1 * 8/2016 Mazzei ..... B62D 51/02
(Continued)

*Primary Examiner* — Katy M Ebner

(57) ABSTRACT

A hoverboard walker attachment apparatus to motorize a standard walker using a hoverboard. The apparatus has a principal support having a vertical stem, a pair of arms, and a hoverboard clamp on a base of the principal support. The hoverboard clamp is removably disposed on a middle of a hoverboard such that it is completely fixed. A pair of walker clamps is disposed on a distal end of each of the pair of arms. Each of the pair of walker clamps is removably disposed on a leg of a walker such that it is completely fixed. A user sits on a seat of the walker and places his or her feet onto a pair of platforms of the hoverboard. A kill switch is in operational communication with the hoverboard and may be disposed on the walker, wherein the kill switch is configured to cut power to the hoverboard.

1 Claim, 4 Drawing Sheets

(56) References Cited

U.S. PATENT DOCUMENTS

| | | | | |
|---|---|---|---|---|
| 9,463,122 | B2 * | 10/2016 | Pirone | A61G 5/1051 |
| 9,523,983 | B2 * | 12/2016 | Chamberlain | G05D 1/0242 |
| 9,650,061 | B2 * | 5/2017 | Katayama | B62B 5/0069 |
| 9,688,340 | B1 * | 6/2017 | Kroymann | B62K 13/04 |
| 9,701,329 | B2 * | 7/2017 | Johnson | B62B 3/008 |
| 9,744,095 | B1 * | 8/2017 | Mazzei | A61H 3/04 |
| 9,745,013 | B2 * | 8/2017 | Wood | B62K 11/007 |
| 9,757,290 | B1 * | 9/2017 | Scognamiglio | A61G 5/10 |
| 9,796,401 | B1 * | 10/2017 | Ammirati | B62B 5/005 |
| 9,839,570 | B2 * | 12/2017 | O'Sullivan | A61H 3/04 |
| 9,872,805 | B2 * | 1/2018 | Bach Castillo | B62K 5/025 |
| 9,957,006 | B2 * | 5/2018 | Tinaphong | B62K 11/007 |
| 9,968,507 | B2 * | 5/2018 | Rabin | A61H 3/04 |
| 10,040,503 | B2 * | 8/2018 | Chen | B62K 11/007 |
| 2008/0115982 | A1 * | 5/2008 | Lin | A61G 5/047 180/13 |
| 2010/0237645 | A1 * | 9/2010 | Trainer | G09F 15/0087 296/21 |
| 2011/0095508 | A1 * | 4/2011 | Chiu | A61G 5/047 280/304.1 |
| 2011/0304121 | A1 * | 12/2011 | Chiu | A61G 5/047 280/304.1 |
| 2013/0038036 | A1 * | 2/2013 | Lester | A61G 5/10 280/304.1 |
| 2015/0351979 | A1 * | 12/2015 | Conte | A61G 5/047 180/13 |
| 2017/0127842 | A1 * | 5/2017 | Sayed | A61G 5/10 |
| 2017/0203811 | A1 * | 7/2017 | Germanovsky | B62K 27/003 |
| 2017/0205820 | A1 * | 7/2017 | Liu | G05D 1/0016 |
| 2017/0225736 | A1 * | 8/2017 | Chen | B62K 11/007 |
| 2017/0326019 | A1 * | 11/2017 | Bramsiepe | A61H 3/04 |
| 2017/0360632 | A1 * | 12/2017 | Slorance | A45C 5/14 |
| 2018/0029662 | A1 * | 2/2018 | Acciardi | B62K 11/14 |
| 2018/0141609 | A1 * | 5/2018 | Newhouse | B62K 17/00 |
| 2018/0148080 | A1 * | 5/2018 | Huizinga | B62B 1/00 |

* cited by examiner

HOVERBOARD WALKER ATTACHMENT APPARATUS

BACKGROUND OF THE INVENTION

Various types of motorized walkers are known in the prior art. However, existing motorized walkers are expensive and are integral units that must replace a traditional walker. What is needed, and what the present hoverboard walker attachment apparatus provides, is a means of motorizing a traditional walker using another piece of easily acquired technology: a hoverboard. What is needed is a principal support having a vertical stem, a joint, a pair of arms, a hoverboard clamp, and a pair of walker clamps to join the hoverboard to the walker.

FIELD OF THE INVENTION

The present invention relates to motorized walkers, and more particularly, to a hoverboard walker attachment apparatus.

SUMMARY OF THE INVENTION

The general purpose of the present hoverboard walker attachment apparatus, described subsequently in greater detail, is to provide a hoverboard walker attachment apparatus that has many novel features that result in a hoverboard walker attachment apparatus that is not anticipated, rendered obvious, suggested, or even implied by prior art, either alone or in combination thereof.

To accomplish this, the present hoverboard walker attachment apparatus includes a principal support having a vertical stem and a pair of arms disposed on a joint thereof. A hoverboard clamp is disposed on a base of the principal support. The hoverboard clamp is removably disposed on a middle of a hoverboard such that it is completely fixed and secure. A pair of walker clamps is disposed on a distal end of each of the pair of arms. Each of the pair of walker clamps is removably disposed on a leg of a walker such that it is completely fixed and secure. A user sits on a seat of the walker and places his or her feet onto a pair of platforms of the hoverboard. A kill switch in operational communication with the hoverboard may be disposed on the walker, wherein the kill switch is configured to cut power to the hoverboard. A braking mechanism that is in operational communication with the hoverboard may also be disposed on the walker.

Thus have been broadly outlined the more important features of the present hoverboard walker attachment apparatus so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
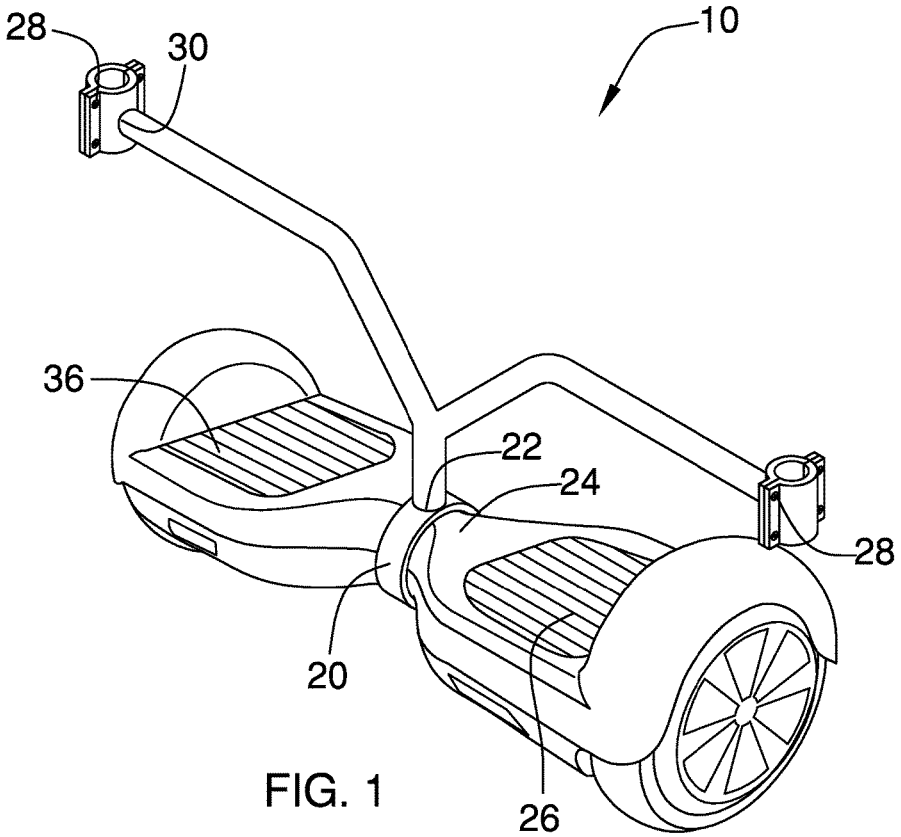
FIG. 1 is an isometric view of a hoverboard walker attachment apparatus attached to a hoverboard.
Figure 2:
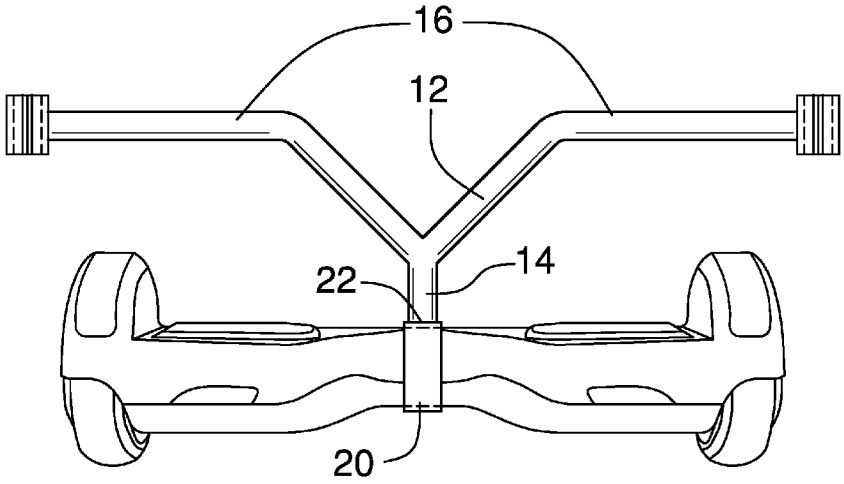
FIG. 2 is a rear elevation view of the hoverboard walker attachment apparatus attached to a hoverboard.
Figure 3:
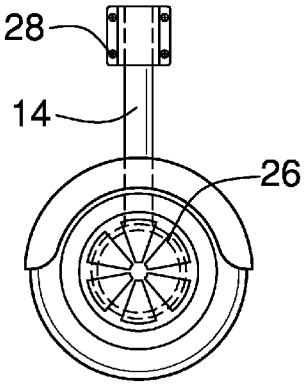
FIG. 3 is a side elevation view of the hoverboard walker attachment apparatus attached to a hoverboard.
Figure 4:
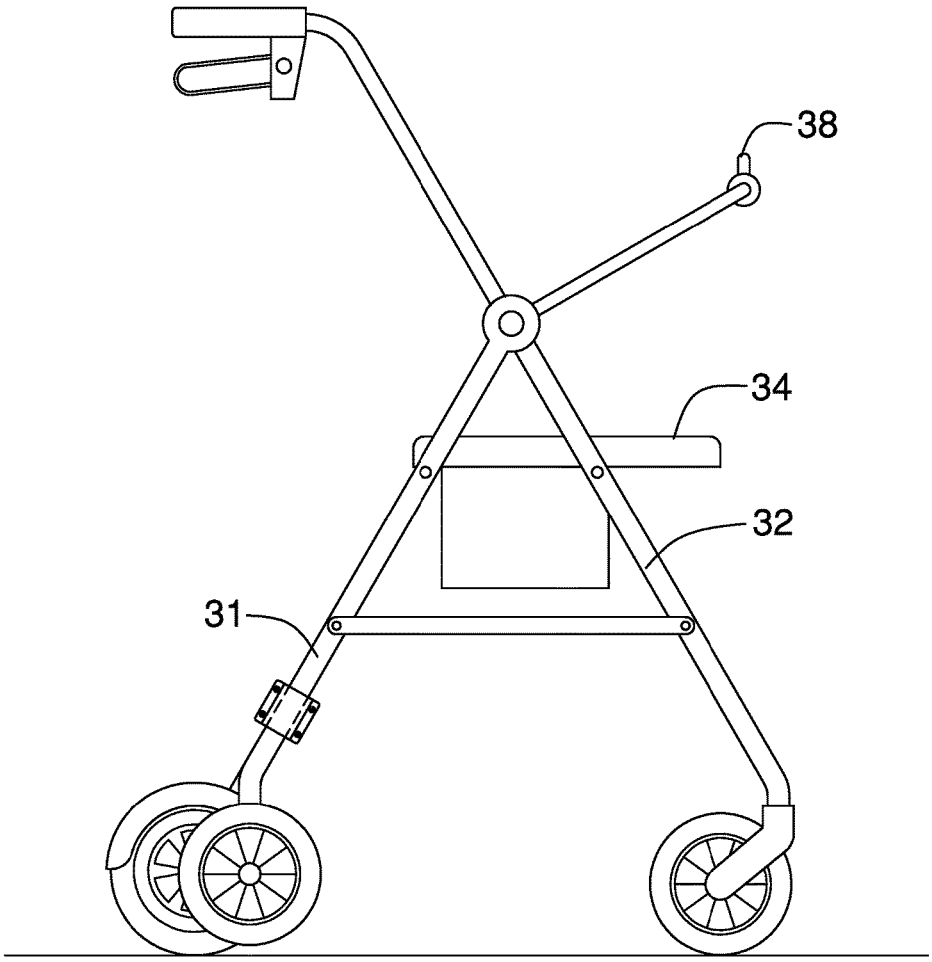
FIG. 4 is an in-use side elevation view of the hoverboard walker attachment apparatus attached to a hoverboard and a walker.
Figure 5:
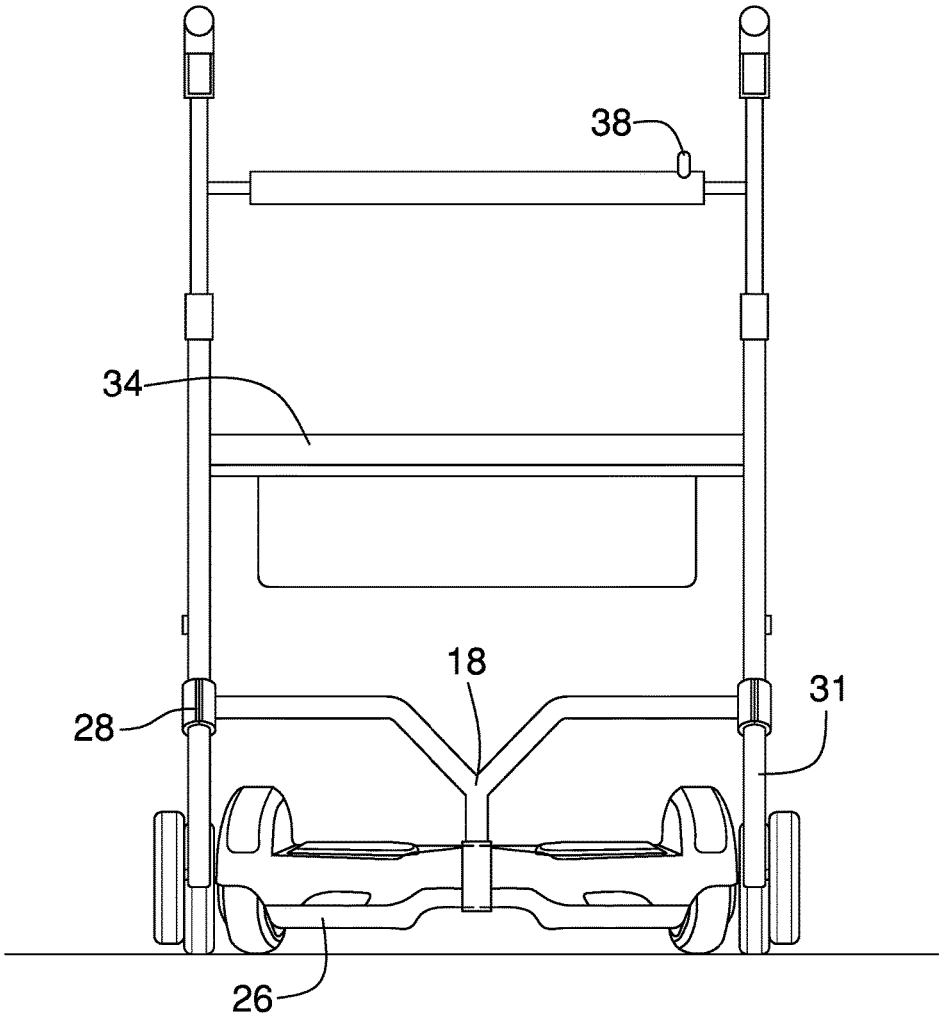
FIG. 5 is a rear elevation view of the hoverboard walker attachment apparatus attached to a hoverboard and a walker.

With reference now to the drawings, and in particular FIGS. 1 through 5 thereof, an example of the instant hoverboard walker attachment apparatus employing the principles and concepts of the present hoverboard walker attachment apparatus and generally designated by the reference number 10 will be described.

Referring to FIGS. 1 through 5 the present hoverboard walker attachment apparatus 10 is illustrated. The hoverboard walker attachment apparatus 10 includes a principal support 12 having a vertical stem 14 and a pair of arms 16 disposed on a joint 18 thereof. A hoverboard clamp 20 is disposed on a base 22 of the principal support 12. The hoverboard clamp 20 is removably disposed on a middle 24 of a hoverboard 26 such that it is completely fixed and secure. A pair of walker clamps 28 is disposed on a distal end 30 of each of the pair of arms 16. Each of the pair of walker clamps 28 is removably disposed on a leg 31 of a walker 32 such that it is completely fixed and secure. A user sits on a seat 34 of the walker 32 and places his or her feet onto a pair of platforms 36 of the hoverboard 26. A kill switch 38 in operational communication with the hoverboard 26 may be disposed on the walker 32, wherein the kill switch is configured to cut power to the hoverboard.

What is claimed is:

1. A hoverboard walker attachment apparatus comprising:

a principal support having a vertical stem and a pair of arms disposed on a joint thereof;

a hoverboard clamp disposed on a base of the principal support, wherein the hoverboard clamp is removably disposed on a middle of a hoverboard; and a pair of walker clamps, wherein each of the pair of walker clamps is disposed on a distal end of each of the pair of arms such that each of said walker clamps is positioned outwardly offset from said hoverboard, wherein each of the pair of walker clamps is removably disposed on respective lateral upright sections of a frame of a walker wherein said hoverboard is positioned centrally between said lateral upright sections of said frame of said walker.

* * * * *